United States Patent [19]

Griffin

[11] Patent Number: 4,537,315

[45] Date of Patent: Aug. 27, 1985

[54] KNIFE AND/OR STEEL STORAGE UNIT

[75] Inventor: Michael E. Griffin, Grand Rapids, Mich.

[73] Assignee: F & M Trading Company, Howard City, Mich.

[21] Appl. No.: 606,475

[22] Filed: May 3, 1984

[51] Int. Cl.[3] ..... A47F 7/00

[52] U.S. Cl. ..... 211/70.6; 206/553; 206/572; 211/170; 248/37.3

[58] Field of Search ..... 211/13, 60 T, 60 R, 211/49 D, 168, 170, 69, 99, 81; 248/37.3, 37.6; 312/13, 14; 206/349, 553, 372, 379

[56] References Cited

U.S. PATENT DOCUMENTS

| | | | |
|---|---|---|---|
| 2,002,983 | 5/1935 | Johnson | 211/69 |
| 2,736,426 | 2/1956 | Hamilton | 206/379 |
| 2,959,293 | 11/1960 | Von Meyer | 211/43 X |
| 3,578,153 | 5/1971 | Olson | 211/99 X |
| 3,635,351 | 1/1972 | Homs | 211/42 |
| 4,243,145 | 1/1981 | Woodhead | 211/49 D |
| 4,374,565 | 2/1983 | Neumann | 211/168 X |

*Primary Examiner*—Robert W. Gibson, Jr.

*Attorney, Agent, or Firm*—Price, Heneveld, Huizenga & Cooper

[57] ABSTRACT

A storage unit for knives and/or steels including a series of individual blocks pivotal forwardly within a frame from a generally upright storage position to an inclined access position. The frame and blocks are modular in construction, permitting widening of the frame and addition of blocks by the purchaser subsequent to his initial purchase.

10 Claims, 5 Drawing Figures

KNIFE AND/OR STEEL STORAGE UNIT

BACKGROUND OF THE INVENTION

This invention relates to storage units and, more particularly adapted for the storage of knives, a sharpening steel and the like on a countertop or similar surface.

So-called "knife blocks" have, through the years, become well known in the art. They consist, generally, of a block of wood or similar material having formed therein at spaced intervals a series of blade-receiving pockets. A knife is stored in units of this general type by inserting the blade into its particular pocket until the handle comes into abutment with the block. A single block or combinations of blocks may be adapted to receive a set of steak knives, a butcher knife, a paring knife or knives, a bread knife, a sharpening steel or any of a wide variety of other types of cutlery.

Many currently available knife blocks provide an aesthetically pleasing means for knife storage. They are also functional in the sense that, once the knife is stored, a user's hand cannot accidentally come into contact with the blade as in the case where such knives are stored in drawer trays and the like.

One significant drawback of prior art knife blocks, however, has been the amount of counter space which they occupy and , for that matter, the amount of wood or other suitable material required for their construction. Since knife blocks of the general type under consideration are typically stored on a kitchen countertop against the wall beneath a cupboard, the pockets must be angled sufficiently with respect to the vertical to permit storage and withdrawal of the knife without interference from the bottom of the cupboard. This problem has been solved in prior art knife blocks by forming the pockets at an angle of 45°, more or less, with the vertical permitting insertion and removal of the knives without interference from the bottom of the overhead cupboard. This solution, however, has resulted in extremely bulky knife blocks, many of which are extremely expensive to manufacture, and which, simply stated, require the allocation of excessive space in relation to the aesthetic and functional advantages which they provide.

SUMMARY OF THE INVENTION

The storage unit which is the subject of the present invention comprises spaced end panels, each having forward and rear surfaces, a lower surface adapted to rest on a countertop or the like and having connected therebetween an axle member. A series of knife and/or steel receiving and retaining blocks are pivotally mounted on the axle member, each of the blocks having an elongated receiving pocket therein. Each of the blocks is pivotal forwardly from a storage position at which the pocket and any knife and/or steel contained therein are generally vertical with the handle uppermost to an access position at which the pocket and any knife and/or steel contained therein are at an angle with respect to the vertical, permitting withdrawal of the knife and/or steel from the pocket without interference from an overhead obstruction such as the bottom of a cupboard. Means are provided for retaining each of the blocks in the first position when it has been pivoted rearwardly thereto and in the second position when it has been pivoted forwardly thereto.

DETAILED DESCRIPTION OF THE PREFERRED EMBODIMENT

Figure 1:
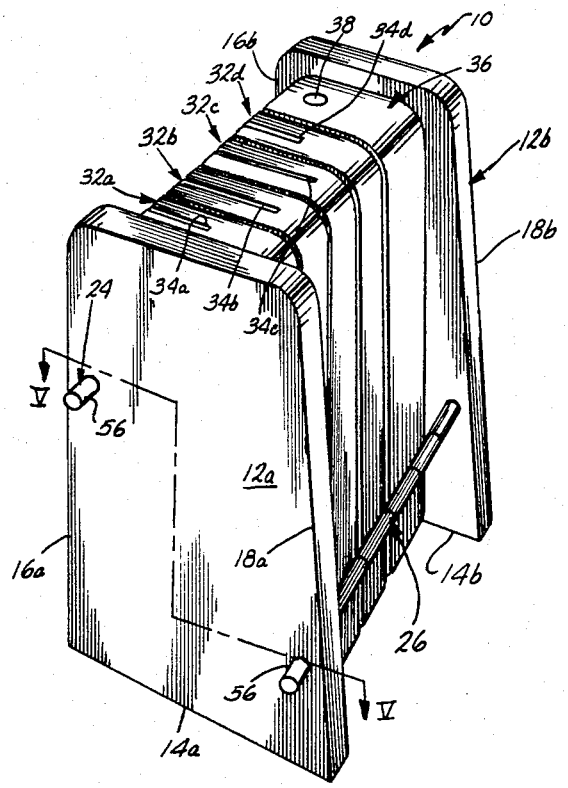
FIG. 1 is a perspective view of the storage unit which is the subject of this invention illustrating the knife and/or steel blocks in the vertical or storage position.
Figure 2:
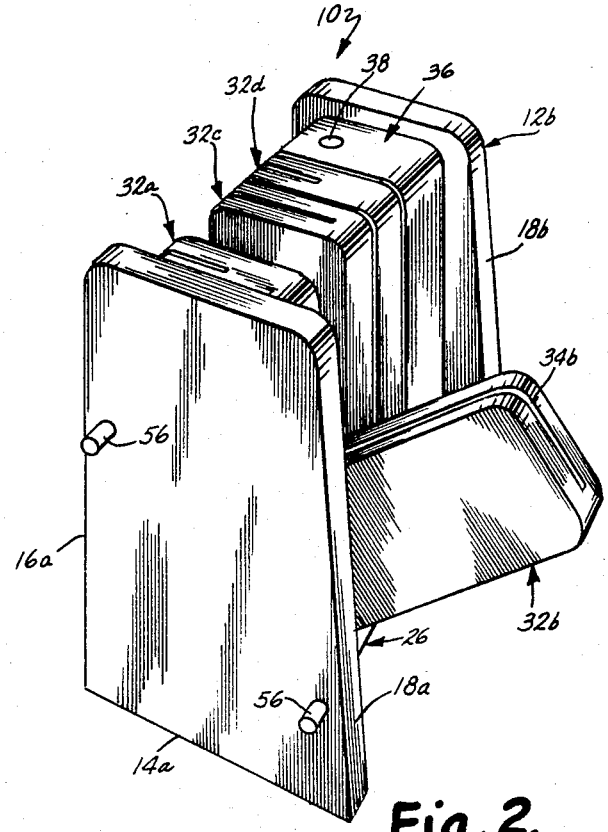
FIG. 2 is a perspective view similar to FIG. 1 except one of the blocks is shown pivoted forwardly to the access position to permit storage and retrieval of a knife and/or steel therein contained without interference from overhead obstructions.
Figure 3:
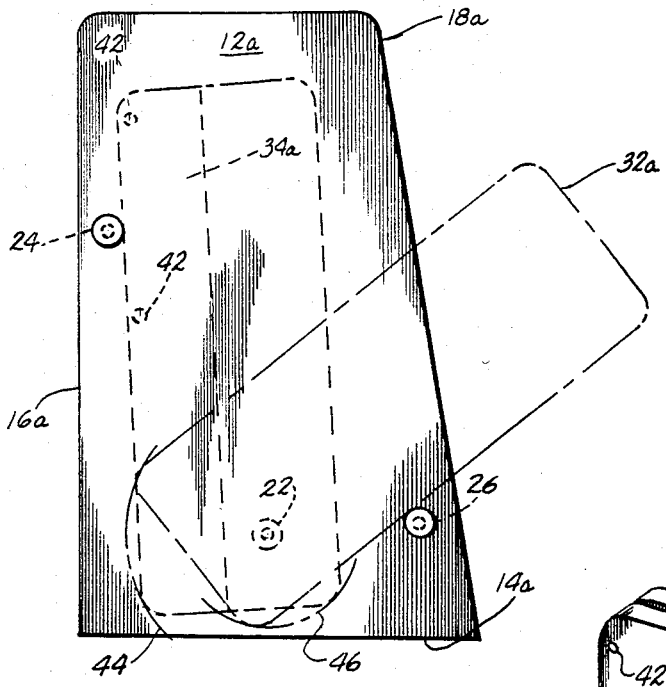
FIG. 3 is a side elevation of the storage unit which is the subject of this invention illustrating a typical knife and/or steel block in both the storage and access positions.

The storage unit 10 which is the subject of the present invention is illustrated generally in FIGS. 1–3. It includes end panels 12*a*, 12*b* having respectively lower surfaces 14*a*, 14*b*, rear surfaces 16*a*, 16*b* and forward surfaces 18*a*, 18*b*. Forward surfaces 18*a*, 18*b*, as best illustrated in FIG. 3, slant forwardly and downwardly. Rear surfaces 16*a*, 16*b* are perpendicular to lower surfaces 14*a*, 14*b*. The unit, in use, will typically rest upon a kitchen countertop with lower surfaces 14*a*, 14*b* in contact with the countertop. It will typically be pushed rearwardly to the wall such that surfaces 16*a*, 16*b* lie close proximity thereto in order to preserve the maximum amount of working space. It will also, typically, be placed beneath a cupboard, as described in the Background.

End panels 12*a* and 12*b* are identical with the exception that countersunk apertures 64 to be discussed hereinafter are on the facing surface thereof. The panels are interconnected by an axle member 22, a rear stop member 24 and a forward stop member 26, also to be described hereinafter. Members 22, 24 and 26 may take the form of continuous metallic rods having a diameter of approximately three-eighths inch and may be suitably secured to the end panels 12*a* and 12*b* in any conventional fashion.

A series of knife blocks 32*a*, 32*b*, 32*c* and 32*d* are pivotally mounted on axle member 22, axle member 22 passing through suitably sized apertures 33*a*, etc., in each of the blocks. Knife blocks 32 each contain pockets 34 running longitudinally with respect to the blocks and opening along the rear faces thereof. Pockets 34 are sized so as to receive knives having varying blade sizes. A single block 32 may be utilized to store two or more smaller knives, such as steak knives or paring knives, by properly positioning dowels 42, as will be described hereinafter.

Storage unit 10 also includes a sharpening steel block 36 pivotally carried on axle member 22 by passage through an aperture located identically to apertures 33. Steel block 36 has a steel receiving pocket 38 drilled therethrough, as will be readily appreciated by those skilled in the art.

End panels 12*a*, 12*b*, knife blocks 32 and steel block 36, in accordance with the preferred embodiment of this invention, are made from wood such as oak, maple or the like. Pockets 34 are formed in blocks 32 by merely running them through a saw blade of appropriate width.

Figure 5:
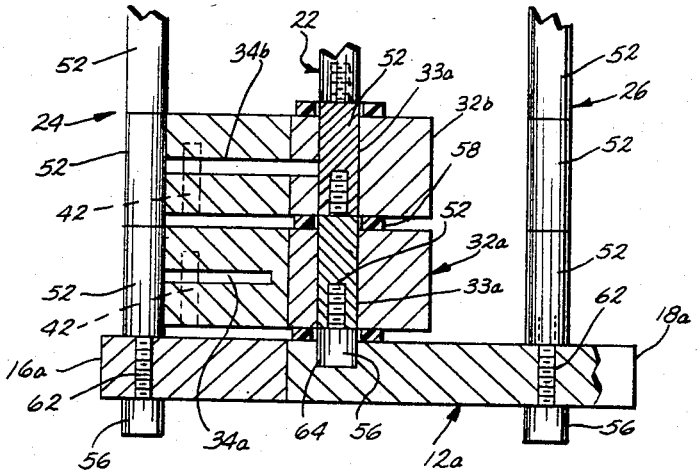
FIG. 5 is a cross-sectional view taken along the planes V—V of FIG. 1.

The pockets are thereafter closed off at the rear edge of the blocks by any suitable means such as wooden dowels 42 (see, also, FIG. 5). Depending on the size of knife to be accommodated in a particular block 32, a series of dowels 42 may be spaced from left to right as viewed in FIG. 5 to form multiple pockets in a single block. Note, also, that the pockets 34 may extend to the right as viewed in FIG. 5 past the axle receiving apertures 33 provided that the knife to be stored in the particular pocket overlying axle member 22 is sufficiently short that its blade will not come into contact with the axle prior to the time that the handle comes into abutment with the top of the particular block.

With particular reference to FIG. 3, blocks 32 and 36 are pivotal from a first position wherein the rear surfaces of the blocks are in contact with rear stop member 24 to a second position wherein the forward surfaces of the blocks are in contact with forward stop member 26. The first position, wherein the pockets 34 and 38 and any knives, steels, etc., contained therein are oriented in a generally vertical direction is the storage position. The second position, wherein the pockets 34 and 38 and any knives, steels, etc., stored therein are oriented at an approximate 45° angle to the vertical is the access position. When all blocks are in the storage position, a particular knife is selected by grasping either its handle or the block within which it is positioned and moving the block to the access position. The knife, etc., may then be withdrawn (or reinserted) without interference from the bottom of the overhead cupboard which will typically overlie the storage unit. The block is then returned to the storage position making available for use the countertop work surface which the block or blocks overlaid while in the access position.

The relative locations of members 22, 24 and 26, the configuration of the end panels and the location of apertures 33 in the knife and steel blocks must be interrelated such that: (a) when blocks 32 and 36 are in their storage positions with knives, etc., in place, the center of gravity of each block lies to the left of axle 22 as viewed in FIG. 3; (b) when the blocks 32 and 36 are in their access position with knives, etc., in place, the center of gravity of the entire storage unit 10 must be to the left, again as viewed in FIG. 3, of the rightwardmost point on countertop-contacting lower surfaces 14*a* and 14*b*; (c) when the blocks 32 and 36 are pivoted from their storage positions to their access positions, arc 46 (FIG. 3) indicating the path of travel of the lower right-hand corner of each individual block does not pass below the plane containing lower surfaces 14*a* and 14*b* of panels 12*a* and 12*b*—i.e., does not strike the countertop; and (d) when each of the blocks 32 and 36 is pivoted between their storage and access positions, the path of travel of the left lowermost corner of each block as indicated by arc 44 in FIG. 3 does not pass beyond the plane containing rear surfaces 16*a* and 16*b* of end panels 12*a* and 12*b*—i.e., does not strike the wall against which the unit is positioned. Satisfactory results have been achieved utilizing: (a) knife and steel blocks having a length of ten inches, a width of three-and-one-half inches and aperture 33 positioned one-and-one-quarter inches from each of the lower and forwardmost surfaces of the individual blocks; (b) end panels having a height of ten-and-three-quarter inches, a top width of approximately five inches, a bottom width of approximately six-and-three-quarter inches, the axle being borne midway between the forward and rear surfaces at a height one-and-three-quarter inches above lower surfaces 14; (c) a rear stop member located approximately three-quarters of an inch from rear surfaces 16 and elevated approximately seven inches above lower surfaces 14; and (d) a forward stop located approximately three-quarters of an inch from forward surfaces 18 and elevated approximately two inches above lower surfaces 14.

Figure 4:
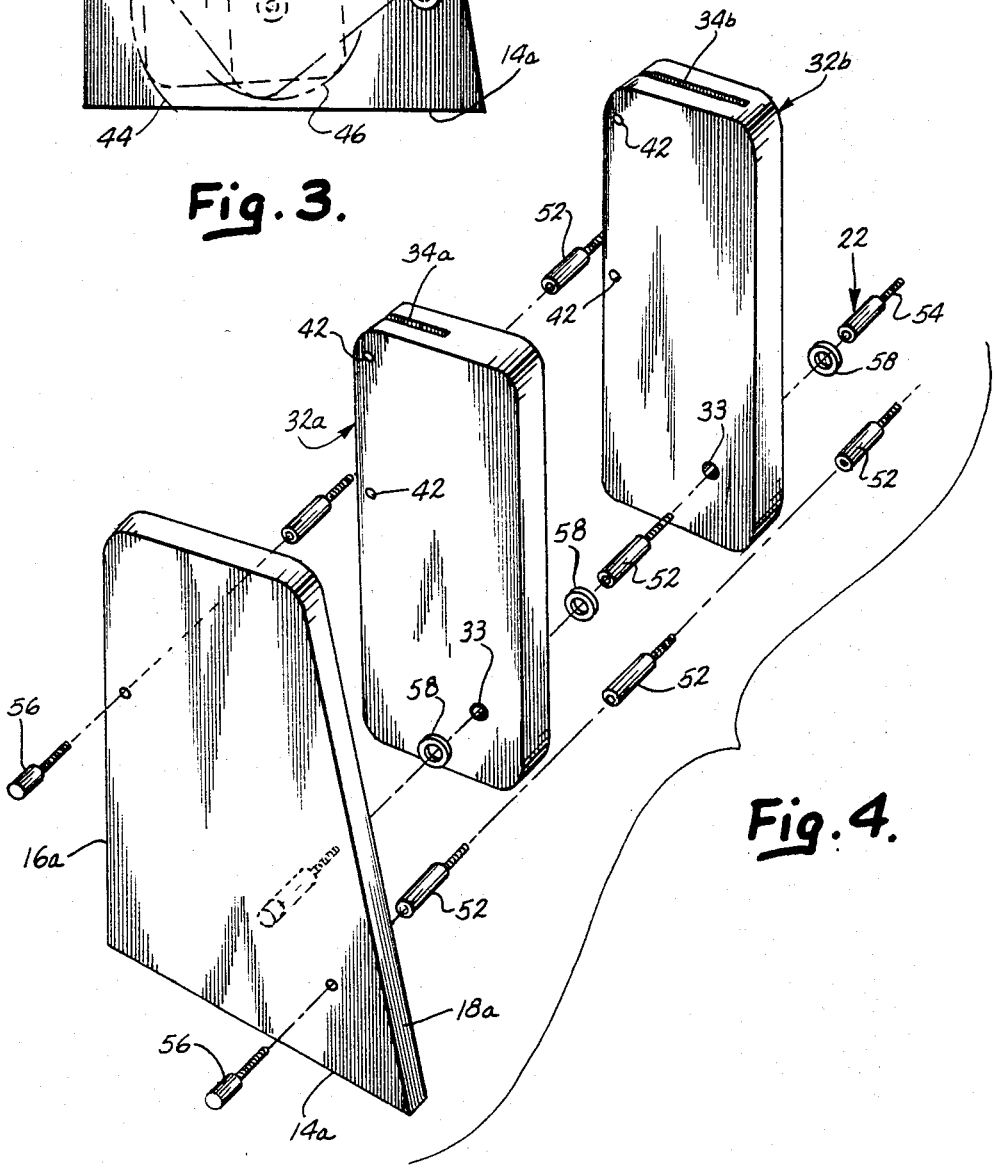
FIG. 4 is a fragmentary, exploded view of the storage unit illustrating, particularly, its modular nature.

The preferred embodiment of the storage unit 10 which is the subject of this invention is modular in the sense that additional knife and/or steel blocks may be added at a time subsequent to the original purchase. To this end, members 22, 24 and 26 are each formed from modular rod segments 52 which have been axially drilled and tapped at either end. Each segment 52 has a length approximately the thickness of a knife block 32 plus the thickness of the washer 58 which surrounds axle member 22 between each adjacent pair of wood surfaces. A threaded rod section 54 is affixed to each of the modular rod segments 52 in the manner shown in FIGS. 4 and 5. Cap screws 56, the threaded sections of which have the same O.D. and pitch as sections 54, complete the hardware necessary to assembly of the storage unit.

The basis or starter unit will be assumed for explanatory purposes to be as shown in FIG. 1. It includes four knife blocks 32 having a thickness of approximately one-and-one-quarter inches and one steel block 38. The steel block, because of the peculiar nature of the steel with which it will be sold, has a thickness equal to twice that of each knife block plus the thickness of a washer 58. With these blocks and end panels come five cap screws 56, eighteen modular rod segments 52, fifteen threaded rod sections 54 and six washers 58.

Assembly is effected by initially forming members 22, 24 and 26, each from six modular rod segments 52 and five interconnecting threaded rod sections 54. One of the cap screws 56 is then affixed to the extremity of axle member 22 as shown in FIG. 5. Blocks 32 and 36 are next placed on axle member 22 with a washer between adjacent blocks and between the two end blocks and the panels 12. The extremities of axle member 22 are then fitted into countersunk apertures 64 in end panels 12. The length of the heads of cap screws 56 is twice the depth of countersunk apertures 64.

One of stop members 24 and 26 is then affixed in position utilizing two of the remaining four cap screws 56 which pass through aperture 62 and end panels 12. The blocks are then pivoted so as to rest against the installed member 24 or 26 and the remaining stop member installed, utilizing the two remaining cap screws. The storage unit is then ready for use.

Should the purchaser, at some later date, decide to add to the storage unit, he need buy only the particular block or blocks desired, three modular rod segments 52, three threaded rod sections 54 and a washer 58 for each block to be added. These components must be doubled, of course, if an additional steel block is desired.

Note that if it is desired to sell a starter kit which is standardized as to number and type—i.e., knife and steel—of blocks, members 22, 24 and 26 as furnished may take the form of continuous rods drilled and tapped at either extremity. Additions may thereafter be made to the starter kit utilizing modular rod segments 52 in the same manner as described in the preceding paragraph.

The present invention, thus, provides a storage unit which occupies a minimal amount of countertop space and yet permits ready access to its contents even when positioned beneath a cupboard. Suitable choices of materials will provide an aesthetically pleasing arrangement. The capacity of the unit may be expanded, in accordance with the preferred embodiment, as desired.

Numerous alternative constructions will be readily apparent to those skilled in the art, particularly if one should not desire to maintain the modular capabilities of the unit. Rear stop 24, for example, could take the form of a wall across the back of the unit or, for that matter, the existing wall between the countertop and the cupboard could perform this function if the end panels are secured in some fashion to the countertop or wall. Forward stop member 26, similarly, could take the form of a bottom wall against which the forward and lowermost corners of the blocks came into abutment when the access position had been reached. Plastic material, of course, could be utilized, as well as wood and/or metal. Such other embodiments and constructions are to be deemed included within the scope of the appended claims unless these claims, by their language, expressly state otherwise.

The embodiments of the invention in which an exclusive property or privilege is claimed are defined as follows:

1. A knife and/or steel storage unit, comprising:

spaced end panels, each having forward and rear surfaces, a lower surface adapted to rest on a countertop or the like;

an axle member extending between and connected to said end panels;

a series of knife receiving and retaining blocks pivotally mounted on said axle member, each of said blocks having a knife-receiving slot opening upwardly of said block and extending longitudinally along said block so as to open to one side thereof, said slots extending from said upward opening downward a sufficient distance to receive and encase the entirety of a knife-blade therein, and each block having at least one closure element secured thereto located adjacent said one side to block access to said slot from said one side and thereby retain a knife received therein;

said blocks pivotally mounted on said axle member so as to pivot forwardly from a storage position at which the slot and any knife contained therein are generally vertical with the handle uppermost to an access position at which the slot and any knife contained therein are at an angle with respect to the vertical permitting withdrawal of the knife from the slot without interference from an overhead obstruction, such as the bottom of a cupboard;

first means for retaining each of said blocks in said storage position, said first retaining means spanning the space between and interconnected to said end panels, the rear surfaces of any given block abutting said first retaining means when the block is in the storage position, and said first retaining means being located relative to said axle member such that the center of gravity of said block is not forward of said axle member when said block is in a storage position; and second means for retaining each of said blocks in said access position, said second retaining means spanning the space between and interconnected to said end panels, the forward surfaces of any given block abutting said second retaining means when the block is in the access position, and said second retaining means being located relative to said axle member such that the center of gravity of said storage unit lies rearwardly from the forwardmost points of said panel lower surfaces.

2. A storage unit as set forth in claim 1 wherein:

said blocks are all substantially the same size, each of said blocks having a said slot that extends from said one side inwardly a distance different from other ones of said slots in other ones of said blocks; and further comprising a steel storage block element pivotally mounted on said axle member, said steel storage block element including a steel receiving aperture opening upwardly therefrom.

3. A knife and/or steel storage unit comprising:

spaced end panels, each having forward and rear surfaces, a lower surface adapted to rest on a countertop or the like and having connected therebetween an axle member;

a series of knife and/or steel receiving and retaining blocks pivotally mounted on said axle member, each of said blocks having an elongated receiving pocket therein, each of said blocks being mounted to pivot forwardly from a storage position at which the pocket and any knife and/or steel contained therein are generally vertical with the handle uppermost to an access position at which the pocket and any knife and/or steel contained therein are at an angle with respect to the vertical permitting withdrawal of the knife and/or steel from the pocket without interference from an overhead obstruction, such as the bottom of a cupboard;

first means for retaining each of said blocks in said storage position when it has been pivoted rearwardly thereto, said first retaining means comprising a first rod member spanning the space between and interconnected to said end panels, the rear surface of any given block abutting said first rod member when the block is in the storage position;

second means for retaining each of said blocks in said access position when it has been pivoted forwardly thereto, said second retaining means comprising a second rod member spanning the space between and interconnected to said end panels, the forward surfaces of any given block abutting said second rod member when the block is in the access position; and said axle member being formed from a series of interconnected segments and which further comprises means for interconnecting said segments whereby the length of said axle member, the spacing between said end panels and the number of said blocks which can be accommodated therebetween can be varied.

4. The storage unit as set forth in claim 3 wherein a washer is interspersed on said axle member between each of said blocks and between said end panels and the blocks adjacent thereto and wherein the length of at least some of said segments approximates the width of one of said blocks plus the width of said washer.

5. The storage unit as set forth in claim 4 wherein said first and second rod members are formed from a series of interconnected segments, said segments being identical to at least some of the segments forming said axle member.

6. A knife and/or steel storage unit comprising:

spaced end panels, each having forward and rear surfaces, a lower surface adapted to rest on a countertop or the like and having connected therebetween an axle member;

a series of knife and/or steel receiving and retaining blocks pivotally mounted on said axle member, each of said blocks having an elongated receiving pocket therein, each of said blocks being mounted to pivot forwardly from a storage position at which the pocket and any knife and/or steel contained therein are generally vertical with the handle uppermost to an access position at which the pocket and any knife and/or steel contained therein are at an angle with respect to the vertical permitting withdrawal of the knife and/or steel from the pocket without interference from an overhead obstruction, such as the bottom of a cupboard;

first means for retaining each of said blocks in said storage position when it has been pivoted rearwardly thereto;

second means for retaining each of said blocks in said access position when it has been pivoted forwardly thereto; and said axle member being formed from a series of interconnected segments and which further comprises means for interconnecting said segments whereby the length of said axle member, the spacing between said end panels and the number of said blocks which can be accommodated therebetween can be varied.

7. The storage unit as set forth in claim 6 wherein a washer is interspersed on said axle member between each of said blocks and between said end panels and the blocks adjacent thereto and wherein the length of at least some of said segments approximates the width of one of said blocks plus the width of said washer.

8. A knife and/or steel storage unit comprising:

spaced end panels, each having forward and rear surfaces, a lower surface adapted to rest on a countertop or the like and having connected therebetween an axle member;

a series of knife and/or steel receiving and retaining blocks pivotally mounted on said axle member, each of said blocks having an elongated receiving pocket therein, each of said blocks being mounted to pivot forwardly from a storage position at which the pocket and any knife and/or steel contained therein are generally vertical with the handle uppermost to an access position at which the pocket and any knife and/or steel contained therein are at an angle with respect to the vertical permitting withdrawal of the knife and/or steel from the pocket without interference from an overhead obstruction, such as the bottom of a cupboard;

first means for retaining each of said blocks in said storage position when it has been pivoted rearwardly thereto;

second means for retaining each of said blocks in said access position when it has been pivoted forwardly thereto;

a washer interspersed on said axle member between at least some of said blocks; and means for selectively lengthening said axle member and, thus, the spacing between said end panels whereby the number of said blocks which can be accommodated therebetween can be varied, said lengthening means comprising an axle segment having a length approximately equal to the width of one of said blocks plus the width of said washer; and which further comprises means for interconnecting said segment and said axle member.

9. A knife and/or steel storage unit comprising:

spaced end panels, each having forward and rear surfaces, a lower surface adapted to rest on a countertop or the like and having connected therebetween an axle member;

a series of knife and/or steel receiving and retaining blocks pivotally mounted on said axle member, each of said blocks having an elongated receiving pocket therein, each of said blocks being mounted to pivot forwardly from a storage position at which the pocket and any knife and/or steel contained therein are generally vertical with the handle uppermost to an access position at which the pocket and any knife and/or steel contained therein are at an angle with respect to the vertical permitting withdrawal of the knife and/or steel from the pocket without interference from an overhead obstruction, such as the bottom of a cupboard;

first means for retaining each of said blocks in said storage position when it has been pivoted rearwardly thereto, said first retaining means comprising a first rod member spanning the space between and interconnected to said end panels, the rear surface of any given block abutting said first rod member when the block is in the storage position; and which further comprises means for selectively lengthening said first rod member;

second means for retaining each of said blocks in said access position when it has been pivoted forwardly thereto, said second retaining means comprising a second rod member spanning the space between and interconnected to said end panels, the forward surfaces of any give block abutting said second rod member when the block is in the access position; and which further comprises means for selectively lengthening said second rod member;

means for selectively lengthening said axle member and, thus, the spacing between said end panels whereby the number of said blocks which can be accommodated therebetween can be varied; and each of said lengthening means being identical; comprises a segment of rod; and which further comprises means for interconnecting one of said segments with said axle and said first and second rod members.

10. The storage unit as set forth in claim 9 wherein a washer is interspersed on said axle member between at least some of said blocks and wherein the length of each of said segments is approximately equal to the width of one of said blocks plus the width of said washer.

* * * * *